United States Patent [19]

Crawford

[11] Patent Number: 4,565,468

[45] Date of Patent: Jan. 21, 1986

[54] MOISTURE IMPERVIENT BARRIER AND METHOD FOR MAKING SAME

[76] Inventor: Leslie A. Crawford, 1010 NE. Crestmoor, Ankeny, Iowa 50021

[21] Appl. No.: 544,503

[22] Filed: Oct. 24, 1983

[51] Int. Cl.[4] ..... E02D 3/12

[52] U.S. Cl. ..... 405/270; 52/169.14; 405/38; 405/129

[58] Field of Search ..... 405/270, 129, 38, 52; 52/169.14

[56] References Cited

U.S. PATENT DOCUMENTS

| | | | |
|---|---|---|---|
| 3,445,322 | 5/1969 | Saiia et al. | 52/169.14 X |
| 3,561,177 | 2/1971 | Agro et al. | 52/169.14 X |
| 4,070,839 | 1/1978 | Clem | 52/169.14 X |
| 4,103,499 | 8/1978 | Clem | 52/169.14 X |
| 4,467,015 | 8/1984 | Clem | 52/169.14 X |

FOREIGN PATENT DOCUMENTS

| | | | |
|---|---|---|---|
| 0059625 | 9/1982 | European Pat. Off. | 405/270 |

*Primary Examiner*—Dennis L. Taylor

*Attorney, Agent, or Firm*—Zarley, McKee, Thomte, Voorhees & Seas

[57] ABSTRACT

A device for providing a moisture impervient barrier, comprises a flexible base sheet member having a layer of bentonite resting on its upper surface. A top sheet member is positioned over the bentonite and is secured to the base member by stitches extending therebetween. The stitches form either a quilting pattern or in the alternative, they can form elongated corrugated compartments filled with bentonite which will swell and break the top sheet member when exposed to water.

8 Claims, 7 Drawing Figures

MOISTURE IMPERVIENT BARRIER AND METHOD FOR MAKING SAME

BACKGROUND OF THE INVENTION

The present invention relates to a device for providing a moisture impervient barrier and a method for making the same.

Many ponds, lagoons and basement structures require a waterproof barrier on the floor and sides thereof. Examples of such applications are waste lagoons, cooling ponds for nuclear plants, and other situations where moisture impervient barriers are necessary at the bottom of a pond or lagoon. Also such barriers are desirable on the floor and walls of some basement structures.

One material which has been found useful for providing such waterproof barriers is bentonite. Bentonite is a clay material which is found in nature and which has the characteristic which enables it to expand upon being exposed to water. When the bentonite expands, it is capable of forming a waterproof barrier. Bentonite is a natural material which is mined and which has the property of being capable of absorbing a great deal of water so as to swell in response to this absorption.

One desirable way to use this bentonite material is to package it in sheets or rolls which can be placed on the bottom of the pond or lagoon so as to form a waterproof barrier thereon. One prior method for providing such a packaged bentonite sheet material utilized the following process:

(a) Using a base polyester sheet material having the ability to permit gases to escape therethrough in a laterial direction.
(b) Applying an adhesive to the upper surface of this sheet material, the adhesive being formed from a starch-like glue.
(c) Applying approximately one-fourth inch of bentonite on top of the adhesive.
(d) Spraying a second coat of adhesive over the top of the bentonite.
(e) Placing a scrim or fine mesh material on top of the adhesive.
(f) Press rolling the above combination into an elongated flat sheet material.
(g) Baking the sheet material in a long oven at approximately 300° F. so as to bake all the moisture out of the sheet material and the bentonite.

The above process was cumbersome, expensive and timeconsuming. The use of adhesive and the baking process contributed substantially to these disadvantages.

Therefore, a primary object of the present invention is the provision of an improved device for providing moisture impervient barriers and the method for using the same.

A further object of the. present invention is the provision of a new moisture impervient material which does not require baking or adhesive as in prior art devices.

A further object of the present invention is the provision of a new moisture impervient material which is easily manufactured and mass produced.

A further object of the present invention is the provision of a moisture impervient material which prevents the seepage of water and the leaching of contaminants from ponds, reservoirs. dams, municipal and industrial waste lagoons, burial sites and other applications A further object of the present invention is the provision of a moisture impervient barrier which greatly simplifies the manufacturing process.

A further object of the present invention is the provision of a moisture impervient barrier which can be manufactured in varying thicknesses for different applications.

A further object of the present invention is the provision of a moisture impervient barrier, which is economical to manufacture, durable in use and efficient in operation.

SUMMARY OF THE INVENTION

The present invention is an improvement over the prior processes for making packaged bentonite sheet materials. The invention involves the use of the following steps:

(a) Using a flat polyester sheet material, preferably a material sold under the trademark "Trevira" by American Hoechst Corporation, Post Office Box 5058, New York. N.Y. 10087. The material is a synthetic non-woven fabric which is a porous, flexible polypropylene material. The sheet material is capable of dissipating gas in a lateral direction so as to permit gas which gathers adjacent the sheet material to pass laterally outwardly through the sheet material.
(b) Applying approximately one-fourth inch of bentonite over the top of the base material.
(c) Applying plain kraft paper or other biodegradable material over, the top of the bentonite. This material must be capable of degrading after hydration.
(d) Stitching the sheet material to the base material with the bentonite being positioned between the two sheets of material. In the preferred form of the invention, the stitches extend in crossing diagonal lines with respect to the longitudinal axis of the sheet material so as to form diamond shaped quilted compartments between the upper sheet material and the base sheet material. The quilted compartments contain bentonite therein. The quilted arrangement prevents the bentonite from shifting during the rolling of the quilted material and during transportation. In another form of the invention, the kraft paper is corrugated so as to form elongated corrugated compartments for containing the bentonite material.

When the above material is placed within a water environment, such as at the bottom of a pond or lagoon, the bentonite expands and breaks the kraft paper layer at the top of the barrier. The bentonite continues expanding so as to cover the stitch holes formed by the stitching, and thereby forms a water impervient material.

DETAILED DESCRIPTION OF THE PREFERRED EMBODIMENT

Figure 1:
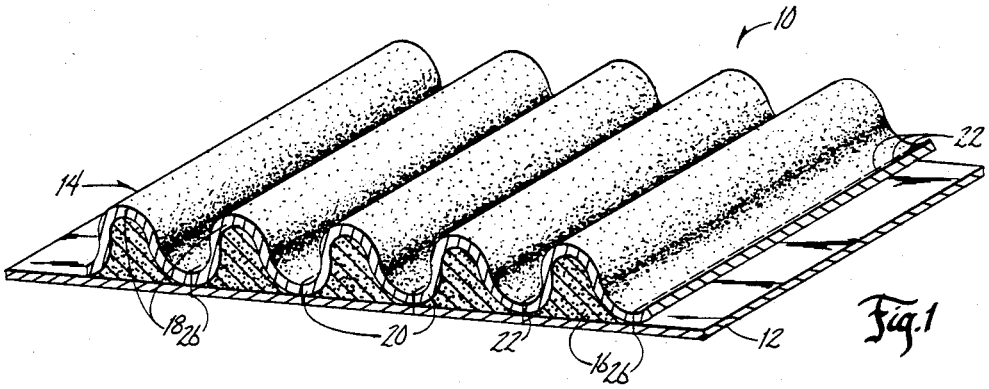
FIG. 1 is a perspective view of the water barrier of the present invention.

Referring to the drawings, the numeral 10 generally designates the moisture impervient barrier of the present invention. Barrier 10 comprises a base sheet material 12, a top sheet material 14, and a bentonite filling material 16.

Base sheet material 12 is preferably formed from a polypropylene material which is porous so as to permit gases to move horizontally within the sheet material. The preferred material is a material sold by American Hoechst Corporation, Post Office Box 5-058, GPO, New York, N.Y. 10087, under the trademark "Trevira" and designated by the product number S11150, and S11200. The material is a non-woven material not knitted or stitched. It is porous to gas and flexible so as to conform to the shape of the bottom of the lagoon or pond on which it is used.

Top sheet member 14 is preferably formed from kraft paper or from some other biodegradable material which will decompose within the water after the barrier is in place. Furthermore, the material must be capable of tearing in response to the expansion of the bentonite within the barrier 10. Preferably the material should be pervious to water so as to permit hydration of the bentonite material. Top sheet member 14 is formed into a plurality of corrugations having concave downward portions 18 and concave upward portions 20. The concave upward portions 20 are adjacent the upper surface of base sheet member 12 and are attached thereto by means of elongated stitch lines 22, the individual stitches of which extend downwardly through both the top sheet member 14 and the base sheet member 20. The thread used for stitch lines 22 is preferably a biodegradable material such as cotton or other material which will decompose with time. Stitch lines 22 extend parallel to one another in a longitudinal direction.

The bentonite is a naturally found material which is clay-like. It is preferably a sodium based Wyoming bentonite ground into granules so as to be easily placed within the spaces below the concave downward portions 18 of top sheet member 14. The bentonite includes the mineral montmorillonite, and the montmorillonite content should be approximately 90%. The bentonite material should be dry with a minimum of 6% moisture, and a maximum of 12% moisture.

Figure 2:
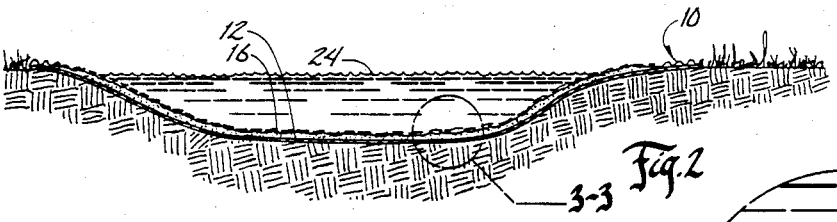
FIG. 2 is a sectional view showing the water barrier placed at the bottom of a pond or lagoon.
Figure 3:
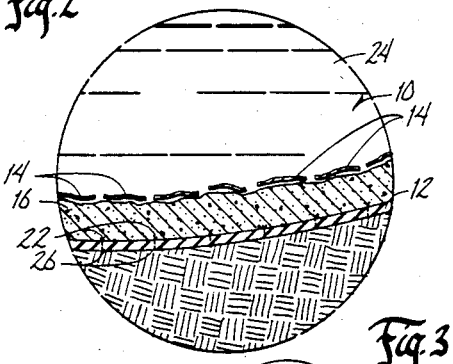
FIG. 3 is an enlarged sectional view taken along line 3—3 of FIG. 2.

FIGS. 2 and 3 show the use of the barrier as a floor for a lagoon or pond 24. When the barrier 10 is placed at the bottom of the pond and is exposed to water, the water passes through the top layer of kraft paper 14 and is absorbed into the bentonite material. The bentonite has the capacity to expand and swell in response to absorbing the water, and it swells to a substantially uniform flat layer of material as shown in FIGS. 2 and 3. This expansion causes the kraft paper 14 to tear and break in response to the expansion so that the bentonite can form a complete layer over the bottom sheet member 12. With time, the paper 14 will decompose, leaving only the bentonite exposed to the water. The bentonite swells and covers the stitch holes designated by the numeral 26 within the bottom layer 12, so as to prevent water from passing therethrough. The stitches 22 are also covered by the bentonite so as to prevent water from escaping by siphoning or wicking through the stitches 22. As time passes, the stitches decompose in the same fashion that the paper 14 decomposes.

Base layer 26, because of its permeability to gases, permits gases to escape laterally when gases are formed beneath the base layer 26 by deomposition. decaying and the like. These gases pass laterally through the barrier 26 and outwardly through the outer edges of the barrier 26. This prevents bubbles or irregular shapes to be forced upwardly from the bottom of the barrier, in response to decaying gases formed beneath the barrier 10.

Figure 5:
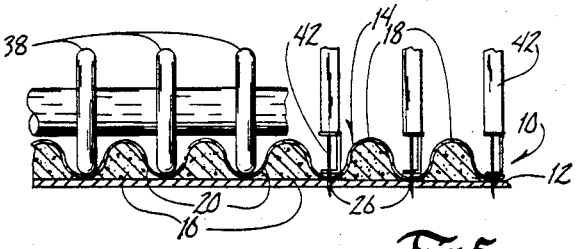
FIG. 5 is a schematic view of the manufacturing process for making the barrier.
Figure 4:
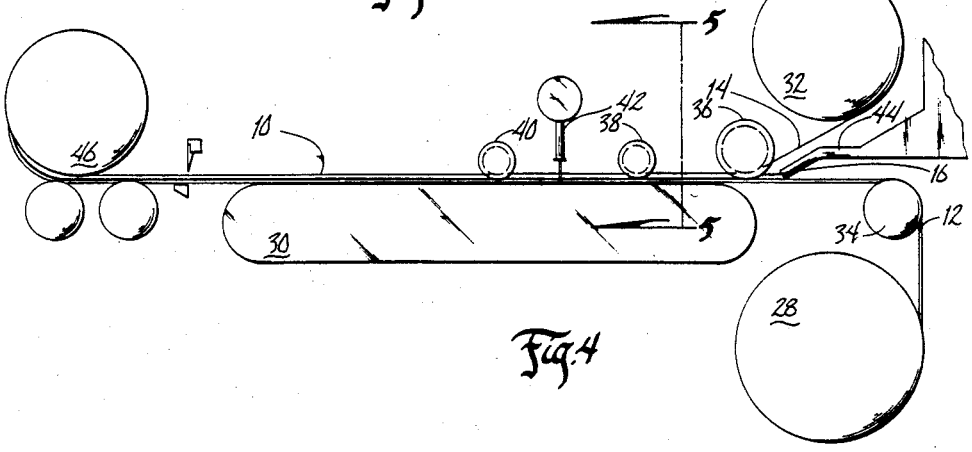
FIG. 4 is a sectional view of the barrier during the manufacturing process.

Referring to FIGS. 4 and 5, the sheet material of the present invention is made in the following manner. A roll 28 of base sheet material 12 is passed horizontally over a conveyor belt 30. An additional roll 32 of kraft paper 14 also passes over conveyor 30. A guide roller 34 provides horizontal support for sheet 12, and a plurality of press wheels 36, 38, 40 hold sheet member 14 in close approximate relationship to the upper surface of sheet member 12.

Referring to FIG. 5, press wheels 38 are spaced apart so as to form the concave upward portions 20 of upper sheet member 14. Press wheels 40 are of similar construction.

Between press wheels 38, 40 are a plurality of stitching needles 42 which provide the stitch lines 22 so as to secure the concave upward portions 20 to the base material 12.

Press wheels 36 are spaced apart in a fashion similar to the press wheels. 38, 40 and a plurality of feed spouts 44 are positioned so as to feed bentonite beneath top sheet 14 in the elongated corrugated compartments formed by downwardly facing concave portions 18.

Figure 6:
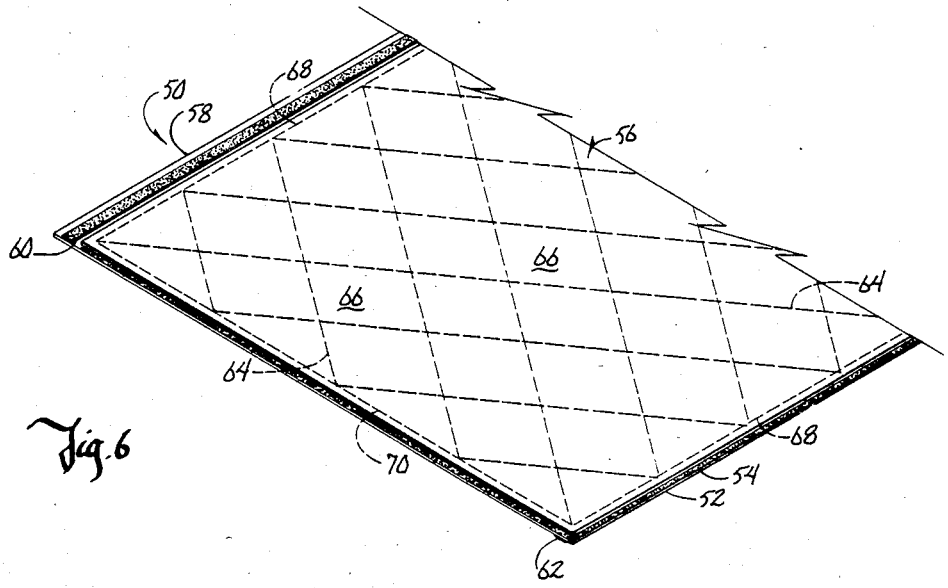
FIG. 6 is a perspective view of a modified form of the present invention.
Figure 7:
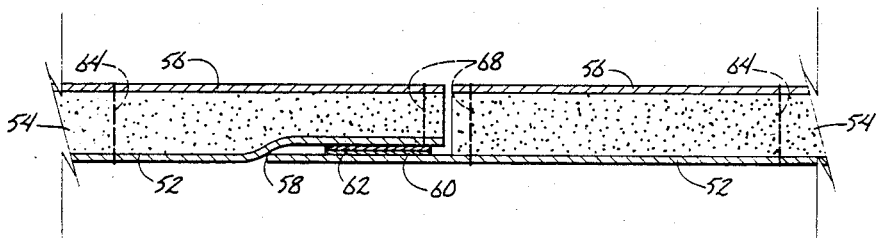
FIG. 7 is a sectional view of the device shown in FIG. 6, showing the manner in which two such devices can be joined in edge relation.

Referring to FIGS. 6 and 7, a modified form of the invention is shown and is designated generally by the numeral 50. The assembly 50 comprises a polyester base sheet material 52 similar to sheet member 26 shown in FIG. 1. Positioned upon sheet member 52 is a layer of bentonite material designated by the numeral 54. Above bentonite 54 is a layer of kraft paper or other biodegradable material 56.

As can be seen in FIG. 6, sheet member 52 has one lateral edge 58 which protrudes beyond the bentonite 54 and kraft paper 56 and which has exposed on its upper surface a strip fastener which is sold under the registered trademark "Velcro" and which is designated by the numeral 60. A matching strip material 62 is attached along the opposite edge of sheet member 60 on the lower surface thereof. Strips 60, 62 are adapted to mate with one another and frictionally engage one another in the fashion shown in FIG. 7 so that two strips of the device 50 may be joined together in the fashion shown in FIG. 7.

Kraft paper 56 is joined to sheet member 52 by means of a quilted stitching designated generally by the numeral 64. Referring to FIG. 6, stitching 64 extends in diagonal lines which form diamond-shaped quilted compartments 66. As can be seen in FIG. 7, stitching 64 does not depress the kraft paper layer 56, but instead spans the distance between layer 56 and layer 52 so as to maintain a substantially uniform thickness for the bentonite 54. The preferred thickness for the bentonite 54 is approximately one-fourth of an inch, but this may be increased or decreased without detracting from the invention. Lateral stitching lines 68, 70 extend around the perimeter of sheet member 56 so as to provide securement adjacent the edges thereof.

The particular machinery for providing the quilted stitching of device 50 is well known in the art. Such machines have long been used for providing quilted stitching to other material. All that needs be added to these present machines is the provision of a bentonite hopper for adding the layer of bentonite between the paper or biodegradable sheet 56 and the base sheet 52.

The quilted device 50 may be used in the same manner as shown in FIG. 2 for the corrugated device 14. However, a preferred method for using the quilted material or the corrugated material is to place approximately six inches of aggregate material on top of the quilted or corrugated layer prior to hydrating the material. This six inch aggregate layer provides a solid anchor for the corregated material and prevents any movement thereof during the hydration process.

It should be noted that no baking or adhesives are required in order to assemble the device, since the stitching holds the barrier together. The barrier is rolled up in a roll 46 and is ready for transporting to the site where the barrier will be used. The thickness of the barrier may be varied depending upon the particular application needed. Adjustment of the thickness is quite easily accomplished merely by changing the height of the quilted components or corrugations formed by upper sheet member 14. The product can be made on a continuous manufacturing basis and is not limited by the need for baking or drying out the bentonite in the middle of the process as was the case with prior processes.

Thus, it can be seen that the device accomplishes at least all of its stated objectives.

What is claimed is:

1. A device for providing a moisture impervient barrier comprising:

a flexible base sheet member having an upper surface, a lower surface and a longitudinal axis, said base sheet member being comprised of a material which is gas permeable in any direction within the plane defined by said base sheet member so as to permit gases to escape through said base sheet member;

a layer of water swellable bentonite resting on said base sheet member, said bentonite layer having a constant thickness;

an elongated flexible top sheet member resting upon the top of said layer of bentonite;

securing means comprising a plurality of thread stitches extending through said base sheet member, said bentonite, and said top sheet member at a plurality of locations for securing the same together, said stitches spanning the distance between said base sheet member and said top sheet member so as to maintain a substantially uniform thickness for said bentonite layer;

said stitches dividing said spaced apart base and top sheet members into a quilted pattern forming a plurality of four sided compartments, each of said compartments containing a portion of bentonite.

2. A device according to claim 1 wherein said top sheet member is comprised of a material which will tear in response to swelling pressure from said bentonite when said bentonite is hydrated.

3. A device according to claim 2 wherein said top sheet member is comprised of paper.

4. A device according to claim 2 wherein said top sheet member is made of a material which is biodegradable when exposed to water.

5. A device according to claim 1 wherein said base sheet member includes an elongated edge thereof which protrudes beyond said bentonite layer so as to have its upper surface exposed.

6. A device according to claim 5 wherein an elongated securing means is attached to said exposed upper surface of said protruding edge, complementary securing means being provided on the under surface of said sheet member adjacent the edge thereof which is opposite from said protruding edge.

7. A method for making a water barrier comprising:

placing a layer having a uniform thickness of water swellable bentonite in covering relation over an elongated flexible base member;

placing a top sheet member made of biodegradable material on top of said layer of bentonite;

securing said top sheet member to said bentonite and said base sheet member by forming thread stitches which extend through said top sheet member, said bentonite layer, and said base member at a plurality of locations;

forming each of said stitches to span the distance between said base sheet member and said top sheet member so as to maintain a substantially uniform thickness for said bentonite layer;

using said stitches to divide said spaced apart base and top sheet members into a quilted pattern forming a plurality of four sided compartments, each of said compartments containing a portion of bentonite.

8. A device for providing a moisture impervient barrier comprising a flexible base sheet member having an upper surface and a lower surface, a layer having a uniform thickness of water swellable bentonite resting on said base sheet member, an elongated flexible top sheet member resting on top of said layer of bentonite, and thread means attaching said base sheet member to said top sheet member at a plurality of locations for securing said bentonite, said base sheet member, and said top sheet member into a unitary flexible laminated member, said device being made according to the process comprising:

placing said layer having a uniform thickness of bentonite on said base layer in a dehydrated form;

placing said top sheet member over said bentonite layer;

extending said thread means through said base sheet member, said bentonite layer and said top sheet member to provide a plurality of stitches at a plurality of locations for securing the same together;

spanning the distance between said base sheet member and said top sheet member with said thread means so as to maintain a substantialy uniform thickness for said bentonite layer;

maintaining said bentonite continuously in a substantially dehydrated state for a period of time beginning before said bentonite is placed on said base sheet member and continuing until after said thread means have been extended through said base layer, said bentonite and said top layer, whereby said bentonite will remain substantially free from swelling during said period of time; and dividing said spaced apart base and top sheet members into a quilted pattern with said stitches so as to form a plurality of four sided compartments, each of said compartments containing a portion of bentonite.

* * * * *